US007543639B2

(12) United States Patent
Emerson

(10) Patent No.: US 7,543,639 B2
(45) Date of Patent: Jun. 9, 2009

(54) OPEN HOLE EXPANDABLE PATCH AND METHOD OF USE

(75) Inventor: Alan B. Emerson, Cypress, TX (US)

(73) Assignee: Baker Hughes Incorproated, Houston, TX (US)

( * ) Notice: Subject to any disclaimer, the term of this patent is extended or adjusted under 35 U.S.C. 154(b) by 0 days.

(21) Appl. No.: 11/187,655

(22) Filed: Jul. 22, 2005

(65) Prior Publication Data

US 2006/0016597 A1 Jan. 26, 2006

Related U.S. Application Data

(60) Provisional application No. 60/590,596, filed on Jul. 23, 2004.

(51) Int. Cl.
*E21B 29/00* (2006.01)
*E21B 43/10* (2006.01)

(52) U.S. Cl. ..... 166/277; 166/207; 166/384

(58) Field of Classification Search ..... 166/277, 166/207, 382, 384
See application file for complete search history.

(56) References Cited

U.S. PATENT DOCUMENTS

| | | | | |
|---|---|---|---|---|
| 1,233,888 | A | 7/1917 | Leonard | |
| 2,812,025 | A | 11/1957 | Teague et al. | |
| 3,825,077 | A | 7/1974 | Jackson | 175/57 |
| 3,889,750 | A | 6/1975 | Mullins | 166/217 |
| 3,912,006 | A | 10/1975 | Nutter | 166/216 |
| 5,348,090 | A | 9/1994 | Leismer | 166/211 |
| 5,531,280 | A | 7/1996 | Steinkamp et al. | 175/230 |
| 6,026,899 | A | 2/2000 | Arizmendi et al. | 166/216 |
| 6,073,693 | A | 6/2000 | Aldridge | 166/217 |
| 7,104,322 | B2 * | 9/2006 | Whanger et al. | 166/277 |
| 2003/0047322 | A1 * | 3/2003 | Maguire et al. | 166/380 |
| 2003/0106696 | A1 * | 6/2003 | Lauritzen et al. | 166/380 |
| 2003/0146003 | A1 * | 8/2003 | Duggan et al. | 166/384 |
| 2003/0183397 | A1 * | 10/2003 | Hoffman | 166/384 |
| 2003/0217865 | A1 * | 11/2003 | Simpson et al. | 175/57 |
| 2004/0118572 | A1 * | 6/2004 | Whanger et al. | 166/384 |
| 2007/0034408 | A1 * | 2/2007 | Benzie et al. | 175/57 |

* cited by examiner

*Primary Examiner*—Giovanna C Wright
(74) *Attorney, Agent, or Firm*—Madan, Mossman & Sriram, PC

(57) ABSTRACT

A patch for placement in a wellbore and associated methods includes a longitudinal member and an anchor that is radially expanded to engage the wall of the borehole to secure the patch against axial and radial movement. The anchor is set using a running tool that radially expands the anchor and the longitudinal body. The anchor may include one or more elements that can be securely engaged within the wellbore. The longitudinal member and/or the anchor may include a sealing element to provide a seal between the wellbore inside and the earth formation surrounding the wellbore.

20 Claims, 9 Drawing Sheets

OPEN HOLE EXPANDABLE PATCH AND METHOD OF USE

CROSS-REFERENCE TO RELATED APPLICATIONS

This application claims priority from U.S. Provisional Application Ser. No. 60/590,596 filed on Jul. 23, 2004, which is incorporated herein by reference.

BACKGROUND OF THE INVENTION

1. Field of the Invention

This invention relates generally to devices and methods for securing a patch within a wellbore.

2. Description of the Related Art

Patches are used in uncased wellbores and wellbore sections to prevent collapse of the wellbore and/or preclude unintended fluid flow into or out of the wellbore. A patch is usually a tubular sleeve that is secured to the wall of the wellbore. The patch may be any desired length. The patch provides structural support and fluid sealing. There are two primary scenarios in which it is often desired to use a wellbore patch.

The first scenario occurs during drilling of a wellbore, particularly through unconsolidated earth. Because the wellbore is not yet lined with a casing, drilling mud and other fluids may undesirably flow into the surrounding earth formations from the wellbore. This not only results in the loss of fluids, but might contaminate production formations. In such an instance, a patch would provide the fluid sealing needed to prevent this fluid loss.

The second scenario occurs during production from an "open hole" wellbore, which lacks casing. In this situation, there is the danger that undesirable fluids, such as water, will migrate from the surrounding earth formation into the borehole. A patch could be placed along the wellbore in the area where fluid ingress occurs to block it.

In order to function correctly, a patch is secured against axial and rotary movement within the wellbore. Running of a drill string, for example, into the wellbore and through the patch will result in torsional and axial forces being imparted to the patch. The patch might be cemented into place. However, this operation is time consuming as the cement needs to be given time to set and later cure. Also, a cleaning tool is assembled and run into the wellbore to clean the excess cement from the patched area once the cement has been placed in the wellbore.

Currently there is not a relatively easy and acceptable method of securing a patch within a wellbore. The present invention addresses some of the above-noted problems of the prior art.

SUMMARY OF THE INVENTION

The invention provides improved devices and methods for securing a patch within an open hole wellbore. The patch is provided with one of a number of types of anchors that is radially expanded to engage the wall of the borehole to secure the patch against axial and radial movement. The anchors are set using a swaging tool that radially expands anchor and the patch. The action of radially expanding the patch actuates the anchor.

In one aspect, a patch for use within a wellbore comprises a generally cylindrical patch body that is radially expandable from a first, reduced diameter condition to a second, enlarged diameter condition, and an anchor portion that is radially expandable to bitingly engage the wellbore.

In another aspect, a method of placing a patch in a wellbore having an internal dimension comprises positioning the patch at a selected location in the wellbore. The patch has a longitudinal body that is radially expandable and an associated anchor that is engageable to a wellbore wall. The anchor is engaged with the wellbore wall in a manner that enables the longitudinal body of the patch to remain at the selected location.

The patch may be made from any suitable material and in any desired form. It may be a solid metallic member, a metallic longitudinal mesh, or a member made from a composite or hybrid material. The anchor may include one or more radially expandable member which can securely engage with the wellbore wall. The anchor is engaged with the borehole wall in a manner that will cause the longitudinal section to remain in the desired location in the wellbore. The longitudinal member and/or the anchor may be made from a suitable material, such as a rubber or another elastomeric material to provide seal between the wellbore well and the longitudinal member to prevent fluid flow between the formation and the earth formation surrounding the wellbore.

Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

The advantages and further aspects of the invention will be appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE INVENTION

Figure 1:
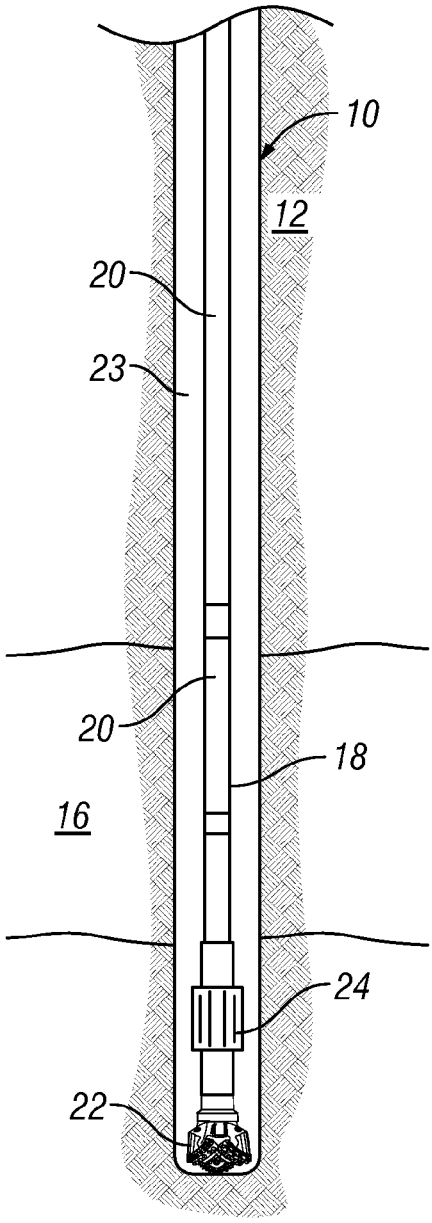
FIG. 1 is a side, cross-sectional view of an exemplary wellbore during drilling.
Figure 2:
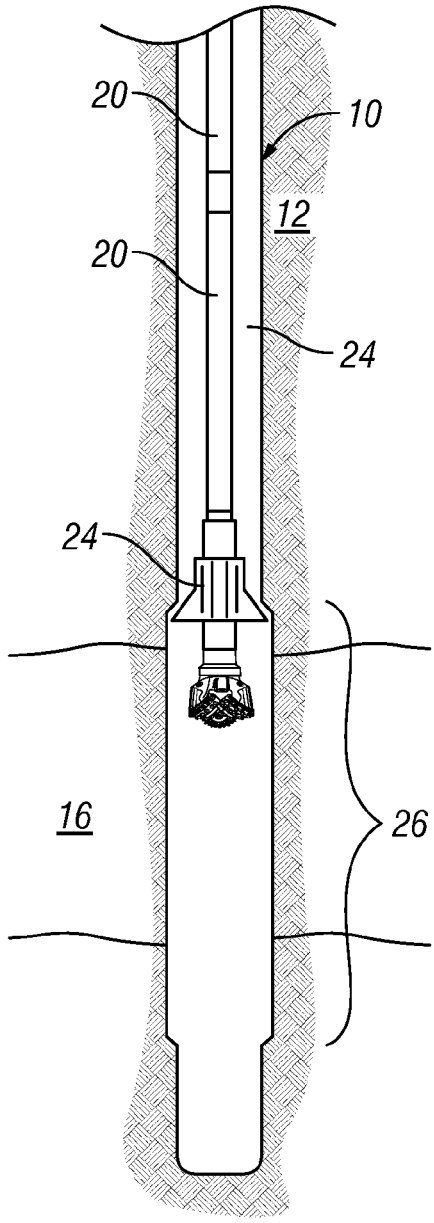
FIG. 2 depicts the wellbore shown in FIG. 1 subsequently being underreamed.

FIGS. 1-5 depict an exemplary wellbore 10 that has been drilled through the earth 12. The wellbore 10 is an open hole wellbore that lacks casing. The surrounding earth 12 contains a permeable zone 16 into which drilling fluids might flow during the drilling operations. It is desired to seal the zone 16 off from fluid communication with the wellbore 10. FIG. 1 depicts a drill string 18 disposed within the wellbore 10 for initial drilling of the wellbore 10. The drill string 18 includes a tubing that may be made of interconnected drill pipe members 20, and a drill bit 22 at the lower end. As those of skill in the art understand, during drilling, drilling mud (not shown) is pumped down the string of drill pipe members 20, flows out of the drill bit 22 and returns up the annulus 23 to the surface of the wellbore 10. In this situation, it is desired to prevent the drilling mud from escaping into the permeable zone 16 by setting a patch within the wellbore 10. To accomplish this, an underreaming tool 24, of a type known in the art, is deployed, as shown in FIG. 2, to radially enlarge the section of wellbore proximate the permeable zone 16. The underreamer 24 cuts a radially enlarged wellbore portion 26.

Figure 3:
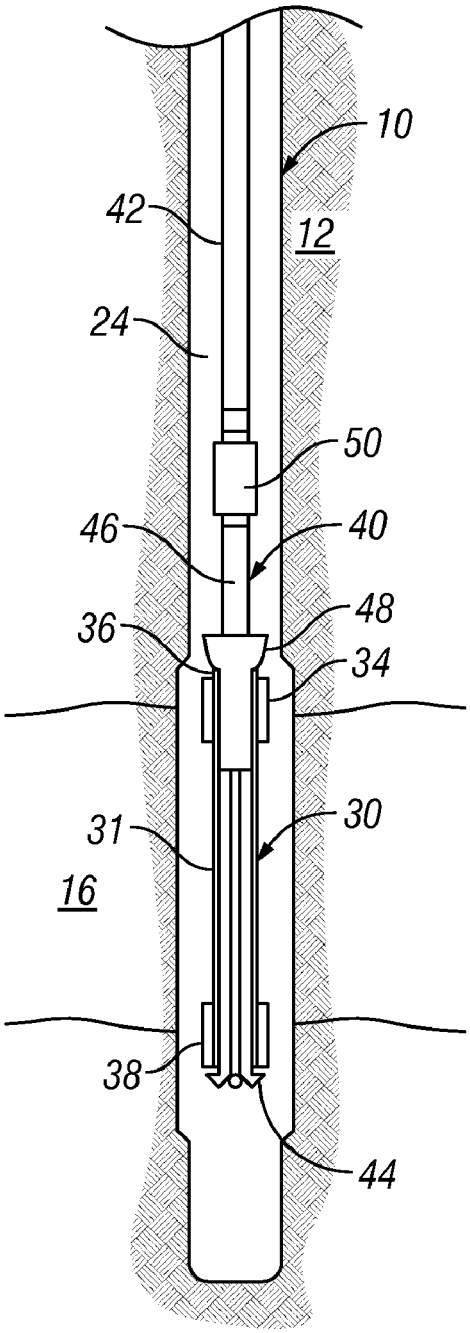
FIG. 3 shows the wellbore of FIGS. 1 and 2 now with a wellbore patch having been disposed therein by a running and setting tool.

Once underreaming has been done, the drill string 18 is withdrawn from the wellbore 10, and a patch 30 is disposed into the wellbore 10, as FIG. 3 illustrates. In FIG. 3, the patch 30 is in a radially reduced configuration. The patch 30 itself has a patch body 31 that includes a tubular section of radially expandable metal or other material. The patch body may be a solid tubular or a mesh. The patch body 31 is typically fashioned of a highly ductile material, such as annealed steel, but may be made for any suitable alloy or a non-metallic or by hybrid material. As noted previously, the patch 30 may be made to any suitable length. In this case, the length of the patch 30 is chosen to ensure complete coverage and fluid sealing across the permeable zone 16. The patch 30 includes an associated anchor or anchor portion, shown schematically at 34. Various configurations for the anchor portion 34 are described in detail later. The anchor portion 34 is shown to be located proximate the upper axial end 36 of the patch 30. Alternatively, it should be understood that the anchor portion might, in fact, be located at any point along the axial length of the patch 30. If desired, additional anchor portions 38 may also be incorporated into the patch 30. The purpose of the anchor portions 34, and 38 is to engage the uncased wall of the wellbore 10 and to secure the patch against axial and radial movement with respect to the wellbore 10.

Figure 4:
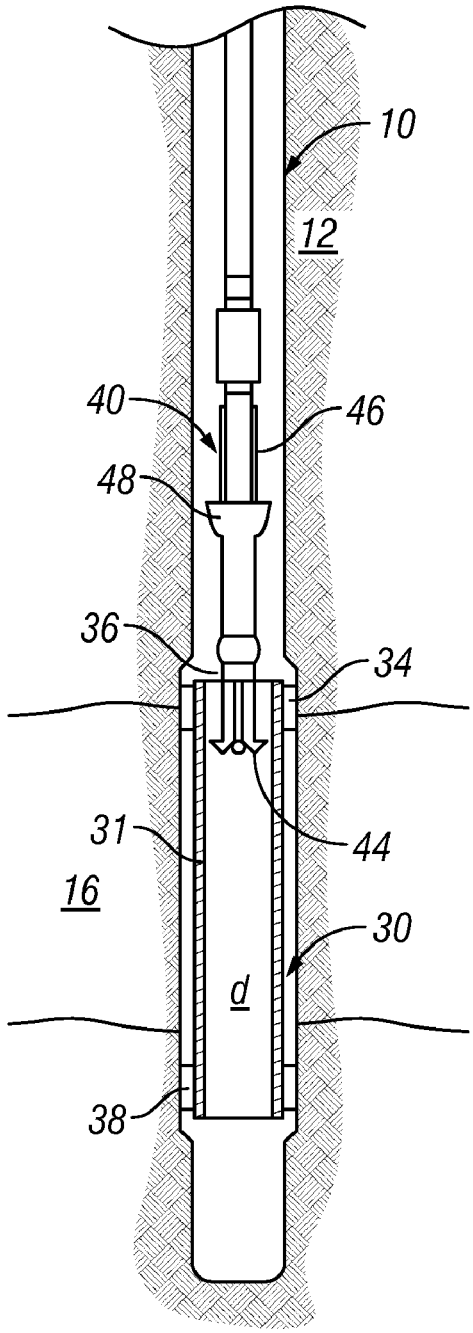
FIG. 4 shows the wellbore of FIGS. 1-3 after the patch has been set within the wellbore.

The patch 30 is run into the wellbore 10 by a running and setting tool 40. The exemplary running and setting tool 40 shown in FIGS. 3 and 4 is suspended by coiled tubing 42, but may be run into the wellbore 10 using a drill pipe or other suitable conveying member known in the art. The running and setting tool 40 includes an engagement shoe 44 at its lower end, upon which the patch 30 rests. Piston 46 and expansion swaging tool 48 are driven by a hydraulic pump 50. Hydraulic fluid may be supplied to the pump 50 from the surface through tubing 42. The running and setting tool 40 may comprise a catEXX™ brand tool, which is available commercially from Baker Oil Tools of Houston, Tex. To set the patch 30 within the wellbore 10, the piston 46 and swaging tool 48 are driven downwardly through the patch 30, radially enlarging it and bringing the anchor portions 34,38 into engaging contact with the wall of the wellbore 10.

Figure 5:
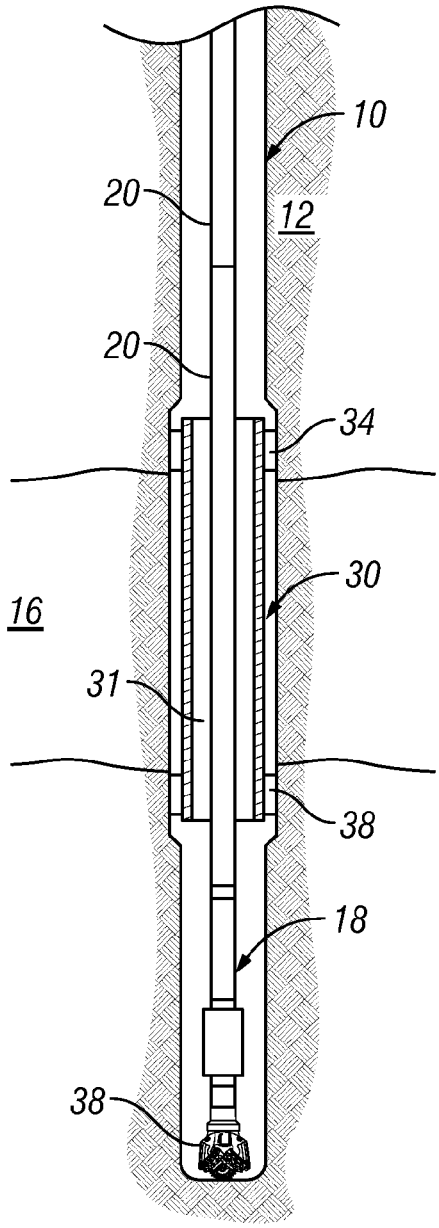
FIG. 5 illustrates subsequent running of a drilling string into the wellbore.

FIG. 4 illustrates the patch 30 after it has been expanded radially, forcing the anchor portions 34 and 38 to engage the wall, thus securing the patch 30 to the wall of the wellbore 10. With the patch 30 set, the running and setting tool 40 maybe withdrawn from the wellbore 10. Subsequently, as FIG. 5 illustrates, a drill string 18 may be reintroduced to the wellbore 10 and the wellbore drilled to a greater depth.

It should be noted that the inside dimensions or the internal diameter of the patch body may be expanded to any desired dimension. The internal diameter may be the same less than or greater than the diameter of the wellbore 10 above or below the enlarged section 26.

Figure 6:
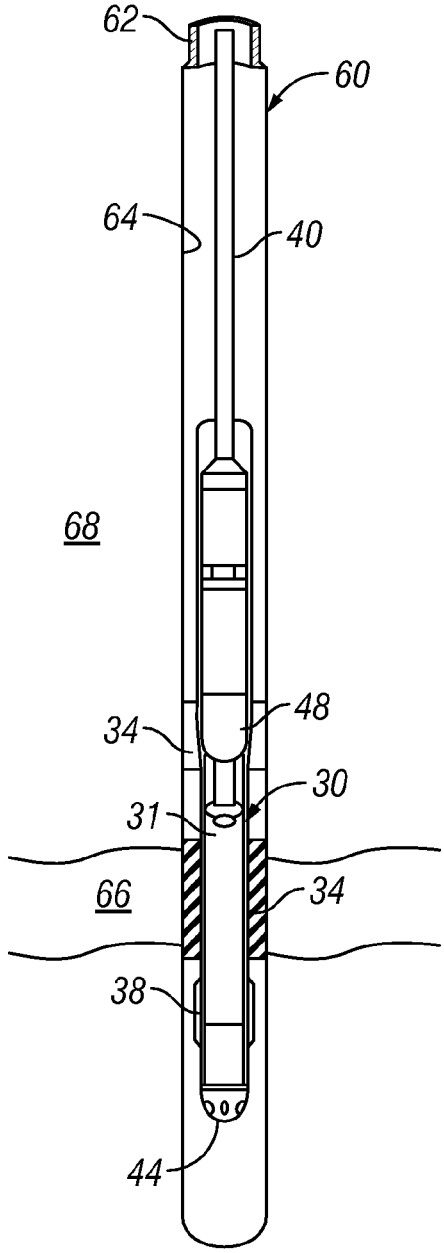
FIG. 6 is side, cross-sectional view of a production wellbore showing a patch being set by a running and setting tool.

FIG. 6 illustrates the setting of a patch 30 in a producing wellbore 60. The wellbore 60 has been partially lined with casing 62 and has an uncased portion 64. A water layer 66 is present in the surrounding earth 68, and water from the layer 66 is undesirably entering the wellbore 60. In FIG. 6, the production assembly (not shown) has been removed from the wellbore 60 so that a patch 30 may be set within. The patch 30 has been lowered into the wellbore 60 on a running and setting tool 40, and is shown during the setting process. Once expanded and set, member 34 of the patch 30 creates a fluid seal at 31, as described later, within the wellbore 60 so that an undesirable fluid, such as water from the layer 66 no longer enters the wellbore 60. Following setting of the patch 30, the running and setting tool 40 is removed from the wellbore 60 and the production assembly (not shown) can be reintroduced to the wellbore 60 to continue production.

Figure 9:
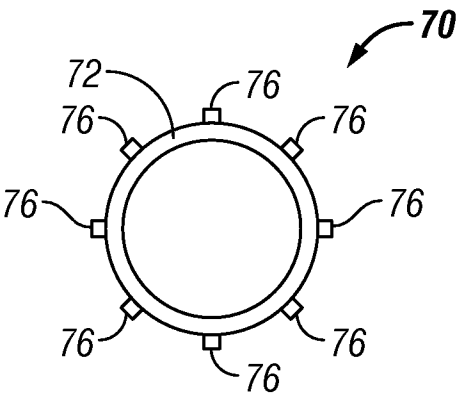
FIG. 9 is an end view of the anchor portion shown in FIGS. 7 and 8.
Figure 8:
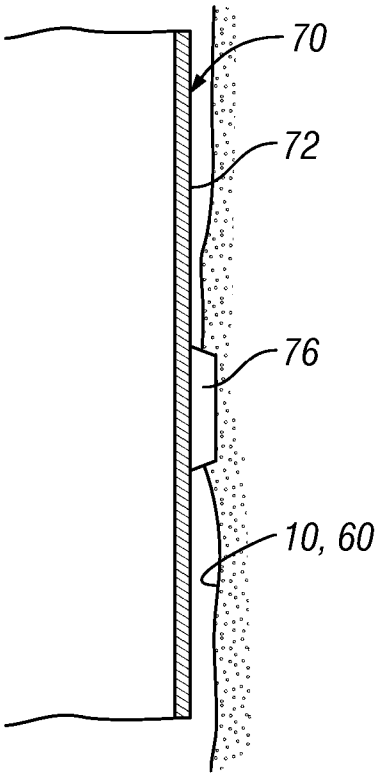
FIG. 8 is a partial, side cross-sectional view of the anchor portion shown in FIG. 7, now in a set position.
Figure 7:
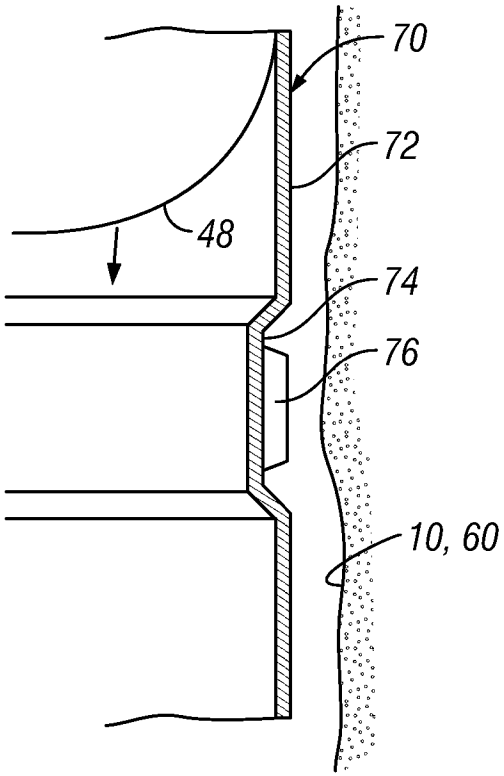
FIG. 7 is a partial side cross-sectional view of a first, exemplary anchor portion, in accordance with the present invention, shown before setting.

Turning now to FIGS. 7-9, there is illustrated a first exemplary anchor assembly 70 which may be used as the anchor portion 34 or 38 on patch 30. The anchor assembly 70 includes a generally cylindrical body member 72 fashioned of a deformable metal or other material. The body member 72 may actually be a portion of the body of the patch 30. A radially reduced channel 74 is formed into the member 72. A plurality of engagement teeth 76 are affixed to the member 72 within the channel 74. Preferably, the teeth 76 are radially spaced about the circumference of the member 72, as shown in FIG. 9.

During running in, the anchor portion 70 is in the position shown in FIG. 7. When set by the running and setting tool 30, the swaging tool 48 deforms the channel 74 outwardly, so that the body member 72 assumes the shape shown in FIG. 8. Deformation of the channel 74 also urges the teeth 76 into biting engagement with the wall of the surrounding wellbore 10,60. This biting engagement secures the patch 30 within the wellbore against axial and rotational movement. If desired, the channel 74 may be omitted altogether, and the teeth 76 brought into biting engagement with the wall of the wellbore 10, 60 merely by radial expansion of the body member 72 via the swaging tool 48.

Figure 11:
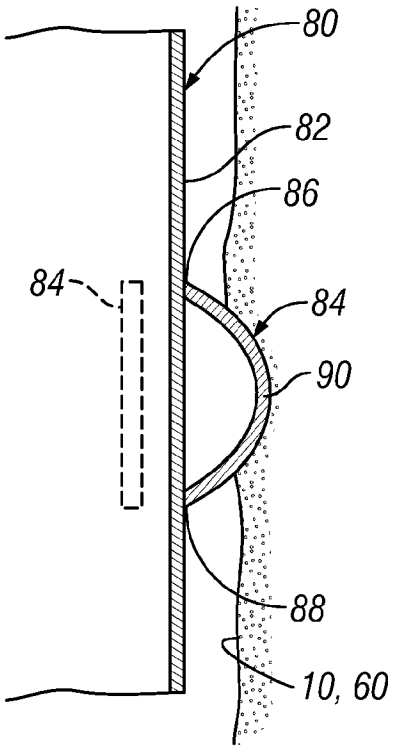
FIG. 11 is a partial, side cross-sectional view of the anchor portion shown in FIG. 10 after setting.
Figure 10:
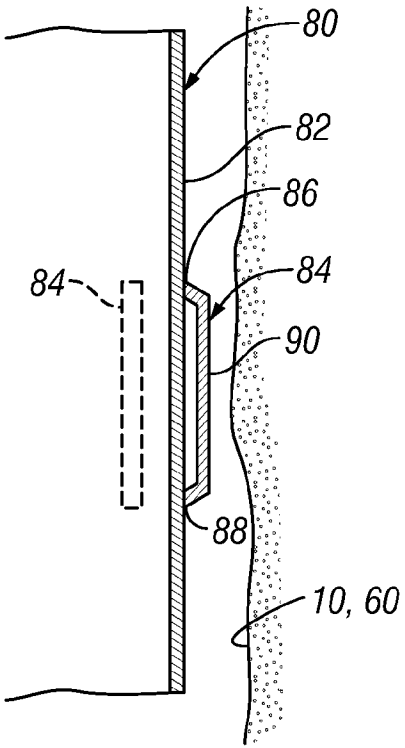
FIG. 10 is a partial, side cross-sectional view of an alternative exemplary anchor portion before setting.

FIGS. 10-11 depict an alternative anchor portion 80 which includes a tubular body member 82 with a plurality of malleable engagement strips 84 secured thereto. Preferably, the engagement strips 84 are disposed in a circumferentially spaced arrangement about the body member 82 in same manner as teeth 76 were. Each of the engagement strips 84 has a pair of axial ends 86, 88 that are welded or otherwise securely affixed to the outer surface of the member 82. Each strip also features a central portion 90 that is unaffixed to the member 82. In the unset position, shown in FIG. 10, the strips 84 are in a substantially linear, unbent condition.

Setting of the anchor portion 80 relies upon the fact that the patch 30, and anchor portion 80, become axially shorter as it is expanded radially. When the swaging tool 48 is urged through the anchor portion 80, the axial shortening of the body member 82 causes the ends 86, 88 of each engagement strip 84 to be moved closer together resulting in the strips 84 bowing outwardly as FIG. 11 depicts. This outward bowing, together with the radial enlargement of the diameter of anchor portion 80 brings the engagement strips 84 into biting engagement with the wall of the wellbore 10, 60.

Figure 14:
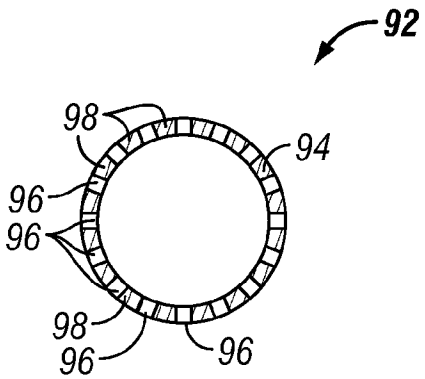
FIG. 14 is an axial cross-section of the anchor portion shown in FIGS. 12 and 13.
Figure 13:
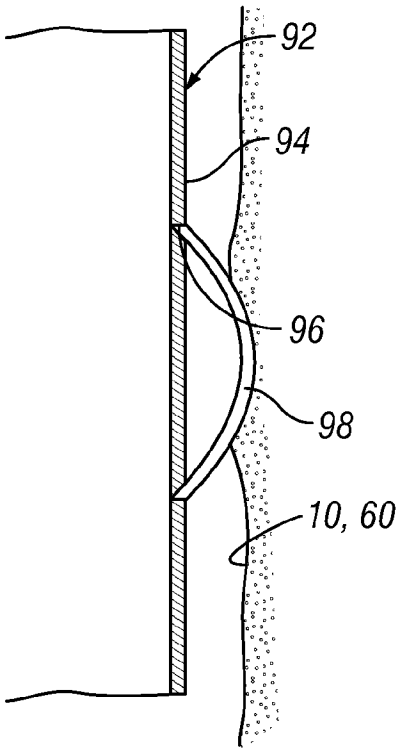
FIG. 13 depicts the anchor portion of FIG. 12 now in a set condition.
Figure 12:
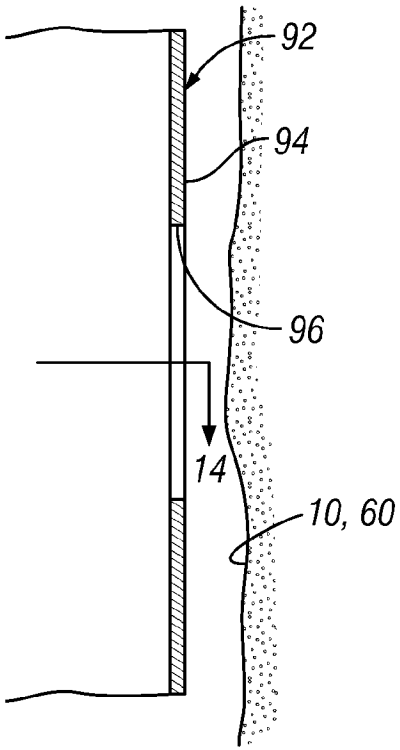
FIG. 12 is a partial, side cross-sectional view of a further alternative anchor portion in an unset condition.

FIGS. 12-14 illustrate a further alternative exemplary anchor portion 92 that features a generally cylindrical body member 94 which has a number of longitudinal slots 96 cut therein. As the cross-sectional view of FIG. 14 illustrates, the slots 96 define a set of body strips 98 therebetween. FIGS. 12 and 14 depict the anchor portion 92 prior to its being set. When the swaging tool 48 is run through the patch 30, axial shortening of the body member 94 will cause the strips 98 to bow outwardly, as FIG. 13 shows, thereby bringing them into biting engagement with the wall of the wellbore 10, 60.

Figure 16:
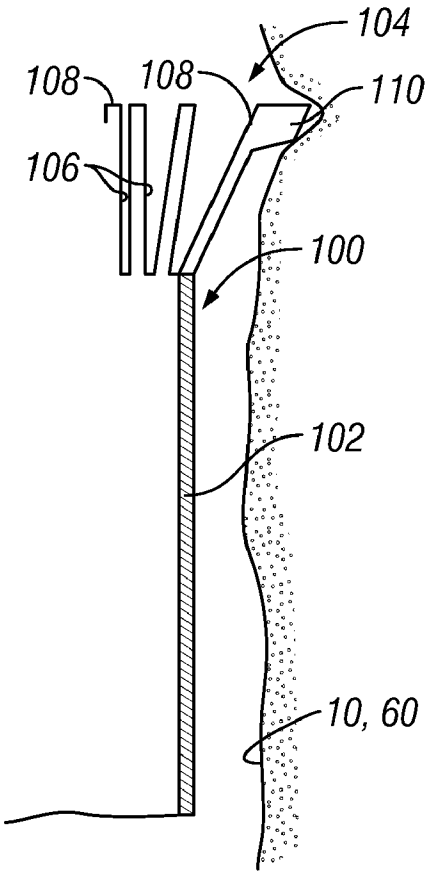
FIG. 16 shows the anchor portion of FIG. 15 now in a set position.
Figure 15:
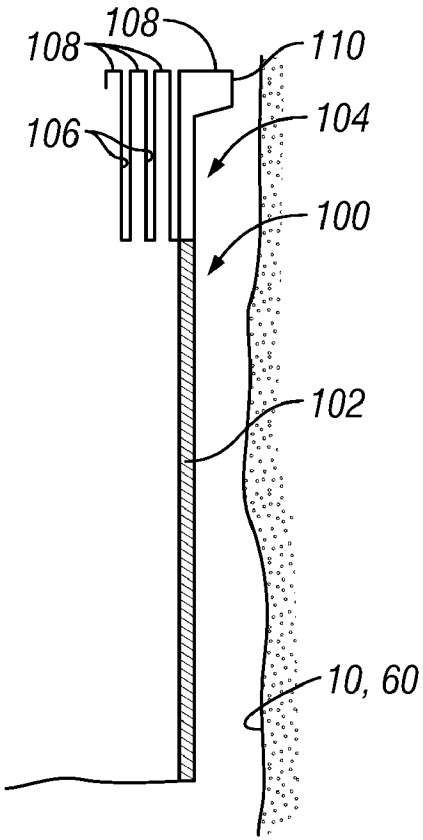
FIG. 15 is a partial, side cross-sectional view of a further alternative anchor portion in an unset position.

FIGS. 15-16 illustrate yet a further alternative anchor portion 100. The anchor portion 100 has a body member 102 with an upper slotted portion 104. The slotted portion 104 includes a plurality of longitudinal slots 106 that define engagement fingers 108 therebetween. Each of the fingers 108 preferably includes an outwardly projecting engagement lip 110. In the unset position, shown in FIG. 15, the fingers 108 extend in the axial direction. However, the swaging tool 48 causes the fingers 108 to bend outwardly, as depicted in FIG. 16 so that they are brought into engagement with the wall of the wellbore 10, 60.

Figure 18:
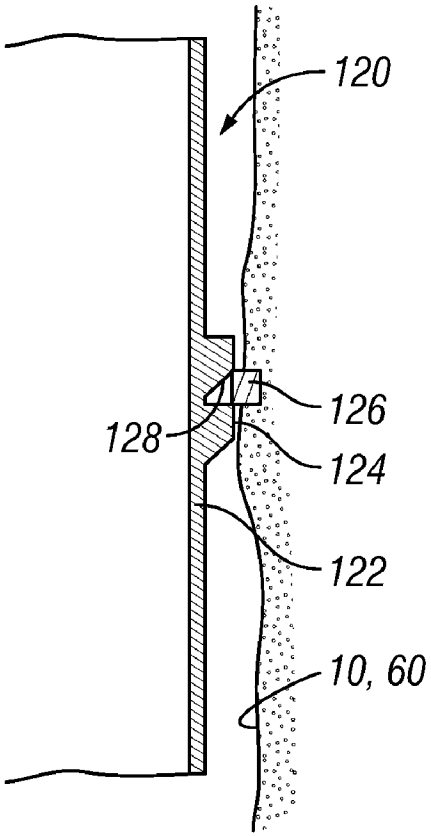
FIG. 18 shows the anchor portion of FIG. 15 in a set position.
Figure 17:
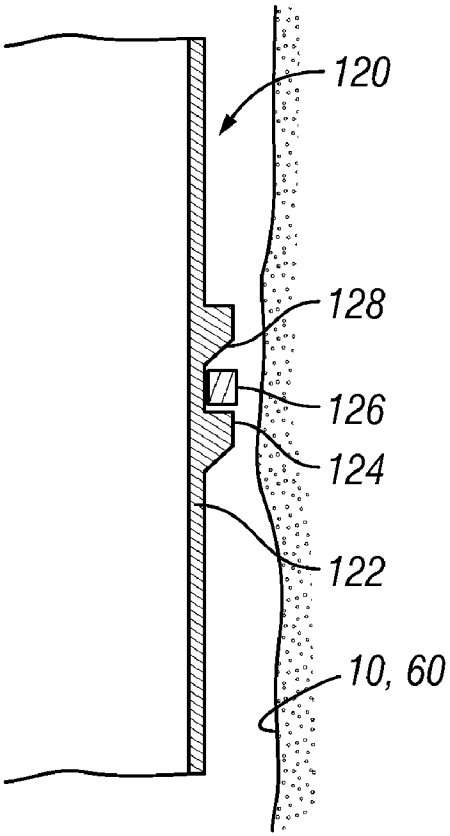
FIG. 17 is a partial, side cross-sectional view of a further alternative anchor portion in an unset position.

FIGS. 17 and 18 depict still a further alternative anchor portion 120. Anchor portion 120 includes a generally cylindrical body member 122 that features an outwardly protruding stop ledge 124. A C-ring 126 surrounds the body member 122 and is located above the stop ledge 124. A sloped face 128 also projects outwardly from the body member 122 and is located above the C-ring 126. FIG. 17 shows the anchor portion 120 in an unset position. In this position, the sloped face 128 is just above the C-ring 126. When the swaging tool 48 is pushed through the anchor portion 120, the body member 122 becomes axially shortened, causing the sloped face 128 to be moved closer to the stop ledge 124. The sloped face 128 then urges the C-ring radially outwardly, as shown in FIG. 18, and into engagement with the wall of the borehole 10, 60.

The anchor also may be made wherein one member moves linearly to cause another member to move out radially to engage the wellbore. The linearly moveable member may be hydraulically operated as noted above or may be mechanically operated or by a combination thereof.

It is noted that the anchor portions described above might be made from or coated or covered with rubbery elastomer, alloy or another sealing material, to provide a fluid sealing capability as well as biting engagement of the wall of the wellbore 10, 60. Additionally, components making up the anchor portions might be fashioned from shape memory material, either metal or composite, the material making up the anchor portion might be initially formed into the set position. The memory effect provided by the material would increase the anchoring effect.

Figure 19:
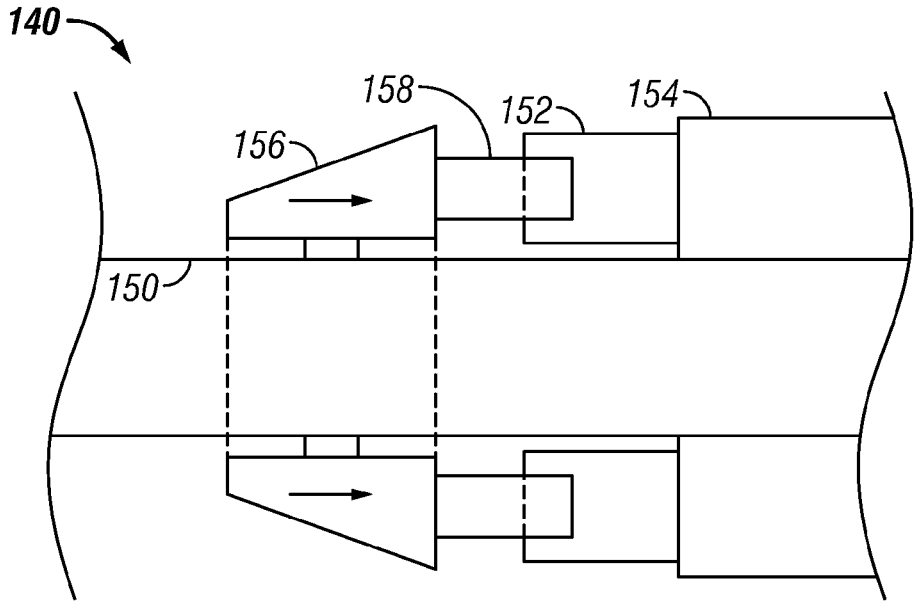
FIG. 19 shows a cone or swaging tool that is for use in enlarging the patch in retracted position.
Figure 20:
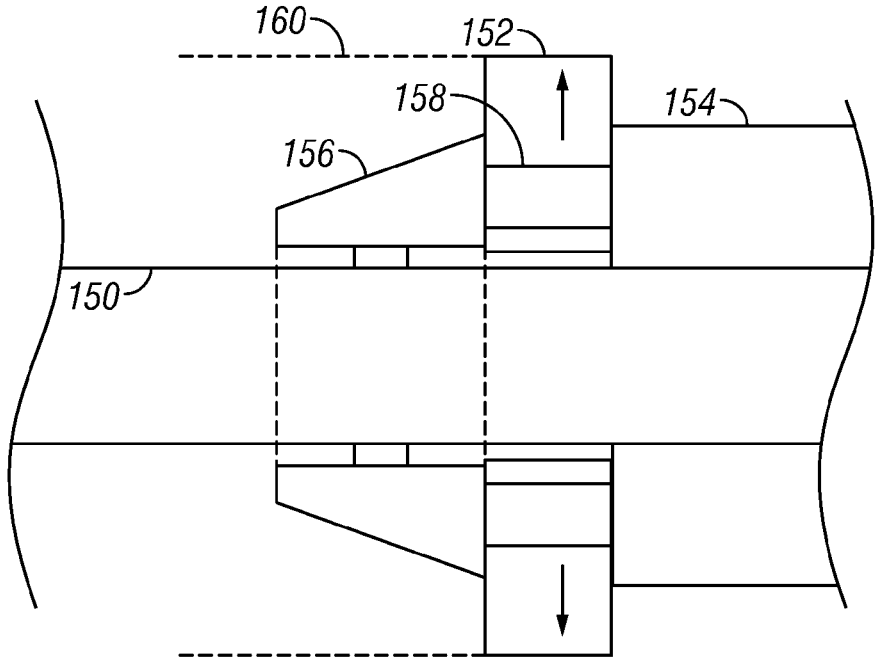
FIG. 20 shows the swaging tool of FIG. 19 after activation in an enlarged position.

FIG. 19 shows a retrievable tool 140 for use in enlarging the patch. The tool 140 includes a mandrel 150 that can be run into the wellbore. A radially expandable swage 150 is disposed around the mandrel 150 between a shoulder member 152 and a linearly movable member 156 to radially enlarge or expand the swage 152, the member 156 is moved linearly toward the swage which moves a force application member 158 toward the swage, causing the swage 152 to move radially outwards as shown in FIG. 20. The member 156 may be moved hydraulically or mechanically or by any other suitable mechanism to retrieve the tool 140 from the wellbore. The member 156 is moved away from the swage 152 which allows the swage 152 to retract. The linear motion of the member 156 controls the rate and the extent of the radial movement of the member 152.

For the sake of clarity and brevity, descriptions of most threaded connections between tubular elements, elastomeric seals, such as o-rings, and other well-understood techniques are omitted in the above description. The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. A patch for use within an uncased section of a wellbore comprising:

(a) a generally longitudinal patch body that is radially expandable from a first, reduced dimension to a second, enlarged dimension, the body having a deformable radially reduced channel;

(b) an anchor positioned in the radially reduced channel, the anchor being radially expandable to bitingly engage a wall of the uncased section of the wellbore; and (c) a sealing member radially outward of and surrounding the anchor, the sealing member and anchor being configured to anchor and seal the patch body.

2. The patch of claim 1 wherein the anchor comprises a tooth configured to engage the wall of the uncased section of the wellbore.

3. The patch of claim 1 wherein the anchor comprises a plurality of radially outwardly extending teeth configured to engage the wall of the uncased section of the wellbore.

4. The patch of claim 1 wherein the anchor is formed of metal.

5. The patch of claim 1 wherein the anchor is formed of composite material.

6. The patch of claim 1 wherein the sealing member comprises one of (i) a rubber material; (ii) an elastomeric sealing portion; (iii) a swelling material; and (iv) a memory material.

7. A method of placing a patch in a wellbore having an internal dimension, comprising:

conveying the patch into the wellbore using a running tool having a shoe on which the patch rests, wherein the patch comprises:

a generally longitudinal patch body that is radially expandable from a first, reduced dimension to a second, enlarged dimension, the body having a deformable radially reduced channel;

an anchor positioned in the radially reduced channel, the anchor being is radially expandable to bitingly engage a wall of the uncased section of the wellbore; and a sealing member radially outward of and surrounding the anchor, the sealing member and anchor being configured to anchor and seal the patch body;

positioning the patch at a selected location in an uncased section of the wellbore, said patch having a longitudinal body that is radially expandable and an associated anchor that is engageable to a wellbore wall;

engaging the anchor to a wall of the wellbore in the uncased section in a manner that enables the longitudinal body of the patch to remain at the selected location; and expanding the patch to have an internal dimension that is at least the same as a dimension of the uncased section of the wellbore.

8. The method of claim 7, wherein the selected location includes a portion of the uncased section of the wellbore that has an enlarged inside dimension, the method further comprising expanding the longitudinal body of the patch to a dimension that is selected from a group consisting of (i) less than the enlarged inside dimension of the uncased section of the wellbore; (ii) substantially the same as the enlarged inside dimension of the uncased section of the wellbore and (iii) less than the dimension of the uncased section of the wellbore above or below the enlarged wellbore dimension.

9. The method of claim 7, further comprising: drilling the wellbore; and enlarging at least a portion of the drilled wellbore adjacent the selected location prior to engaging the anchor with the wellbore wall.

10. The method of claim 9 further comprising drilling the wellbore after placing the patch in the wellbore.

11. The method of claim 7, further comprising expanding the longitudinal body of the patch to a size that is greater than the internal dimension of the uncased section of the wellbore.

12. The method of claim 7, wherein and the enlarging of the anchor provides a fluid seal between a formation surrounding the patch and the wall of the wellbore.

13. The method of claim 7, wherein the anchor comprises one of (i) a tooth that bitingly engages the wall of the wellbore; (ii) a plurality of radially outwardly extending teeth that bitingly engage the wall of the wellbore; (iii) a composite material; (iv) a rubber sealing material; and (v) a memory material.

14. The method of claim 7, wherein engaging the anchor includes radially expanding the anchor with a retractable tool.

15. The method of claim 14, wherein the retractable tool is selected from a group consisting of (i) a hydraulically operated tool; (ii) a mechanically operated tool; (iii) a hydromechanical tool.

16. A method of patching an uncased section of a wellbore, comprising:

(a) positioning a radially expandable tubular at the uncased section of the wellbore, wherein the radially expandable tubular comprises:

a generally longitudinal body that is radially expandable from a first, reduced dimension to a second, enlarged dimension, the body having a deformable radially reduced channel;

an anchor positioned in the radially reduced channel, the anchor being is radially expandable to bitingly engage a wall of the uncased section of the wellbore; and a sealing member radially outward of and surrounding the anchor, the sealing member and anchor being configured to anchor and seal the body;

(b) anchoring the radially expandable tubular to a wall of the wellbore in the uncased section; and (c) expanding the radially expandable tubular to have an internal diameter that is at least the same as a diameter of the uncased section of the wellbore.

17. The method of claim 16 further comprising sealing at least a portion of the uncased section of the wellbore from fluid communication from a formation intersected by the wellbore.

18. The method of claim 16 further comprising: drilling the wellbore, and under-reaming at least a portion of the uncased section of the wellbore.

19. The method of claim 16 further comprising positioning a production string in the wellbore after anchoring the radially expandable tubular at the uncased section of the wellbore.

20. The method of claim 16 further comprising drilling another section of the wellbore after anchoring the radially expandable tubular at the uncased section of the wellbore.

* * * * *